US007281914B2

(12) United States Patent
Lee

(10) Patent No.: US 7,281,914 B2
(45) Date of Patent: Oct. 16, 2007

(54) VARIABLE CAPACITY ROTARY COMPRESSOR

(75) Inventor: Jeong Bae Lee, Hwaseong-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 71 days.

(21) Appl. No.: 11/280,263

(22) Filed: Nov. 17, 2005

(65) Prior Publication Data

US 2007/0003423 A1 Jan. 4, 2007

(30) Foreign Application Priority Data

Jul. 2, 2005 (KR) ..... 10-2005-0059472

(51) Int. Cl.
*F04B 49/00* (2006.01)

(52) U.S. Cl. ..... 418/60; 417/218; 417/221; 418/29

(58) Field of Classification Search ..... 418/60, 418/29, 69, 63; 417/221, 218
See application file for complete search history.

(56) References Cited

U.S. PATENT DOCUMENTS 2,418,412 A * 4/1947 Kucher ..... 418/29
7,104,764 B2 * 9/2006 Lee et al. ..... 417/218
2005/0069442 A1 * 3/2005 Cho et al. ..... 418/26

FOREIGN PATENT DOCUMENTS

KR 2004-32358 4/2004
KR 2005-31797 4/2005

* cited by examiner

*Primary Examiner*—Thomas Denion
*Assistant Examiner*—Mary A Davis
(74) *Attorney, Agent, or Firm*—Stanzione & Kim, LLP

(57) ABSTRACT

A variable capacity rotary compressor has a simplified structure to reduce manufacturing costs and assembling time thereof and is capable of easily and conveniently performing a capacity-changing operation. The variable capacity rotary compressor includes first and second compression chambers having different capacities, a rotary shaft disposed through the first and second compression chambers, first and second eccentric cams mounted at the rotary shaft in the first and second compression chambers, respectively, first and second eccentric bushes rotatably mounted at outer surfaces of the first and second eccentric cams, respectively, a connection part connected between the first and second eccentric bushes, the connection part having a latching groove extending in a rotating direction of the rotary shaft, a latching pin protruding from the rotary shaft such that the latching pin is disposed in the latching groove, and holding grooves depressed by a predetermined depth at opposite ends of the latching groove in a longitudinal direction of the rotary shaft to hold the latching pin therein.

15 Claims, 10 Drawing Sheets

VARIABLE CAPACITY ROTARY COMPRESSOR

CROSS-REFERENCE TO RELATED APPLICATIONS

This application claims the benefit under 35 U.S.C. §119 of Korean Patent Application No. 2005-59472, filed on Jul. 2, 2005, in the Korean Intellectual Property Office, the disclosure of which is incorporated herein in its entirety by reference.

BACKGROUND OF THE INVENTION

1. Field of the Invention

The present general inventive concept relates to a variable capacity rotary compressor, and more particularly, to a variable capacity rotary compressor that is capable of preventing slippage of eccentric bushes.

2. Description of the Related Art

An example of a variable capacity rotary compressor that is capable of changing refrigerant compressing capacity is disclosed in Korean Unexamined Patent Publication No.10-2004-32358, the ownership of which has been assigned to the assignee of this application. The variable capacity rotary compressor comprises an eccentric unit that performs a compressing operation or an idling operation when rollers are eccentric or not in compression chambers as a rotating direction of a rotary shaft of the variable capacity rotary compressor is changed.

The eccentric unit comprises two eccentric cams mounted at an outer portion of the rotary shaft in the respective compression chambers, two eccentric bushes rotatably mounted at outer surfaces of the eccentric cams, respectively, the eccentric bushes having rollers mounted at outer surfaces thereof, and a latching pin to enable one of the eccentric bushes to be eccentric and the other eccentric bush not to be eccentric when the rotary shaft is rotated.

The eccentric unit is operated such that the compressing operation is performed only in one of the two compression chambers having different capacities. Consequently, the capacity-changing operation can be performed merely by changing the rotating direction of the rotary shaft.

In addition, an example of a variable capacity rotary compressor that is capable of preventing slippage of an eccentric bush while a compressing operation is performed is disclosed in Korean Unexamined Patent Publication No. 10-2005-31797, the ownership of which has also been assigned to the assignee of this application.

The compressor is characterized by holding members disposed at opposite ends of a latching groove of the eccentric bush to hold a latching pin. The holding members have a predetermined elasticity to pressurize an outer surface of the latching pin. Specifically, each of the holding members is composed of a spring bent in a Ω-shape.

The latching pin is held by the holding members disposed at the opposite ends of the latching groove when the compressing operation is performed. As a result, slippage of the eccentric bush is prevented, and accordingly, noise generated by collision of the latching pin and the eccentric bush is prevented.

However, in the compressor with the above-stated construction, the holding members are disposed at opposite ends of a latching groove. Consequently, a number of parts is increased, and therefore, manufacturing costs are increased. Furthermore, assembling time is also increased.

SUMMARY OF THE INVENTION

Accordingly, the present general inventive concept provides a variable capacity rotary compressor having a simplified structure to reduce manufacturing costs thereof and to reduce assembling time when the variable capacity rotary compressor is manufactured, and that is capable of easily and conveniently performing a capacity-changing operation.

Additional aspects of the present general inventive concept will be set forth in part in the description which follows and, in part, will be obvious from the description, or may be learned by practice of the general inventive concept.

The foregoing and/or other aspects of the present general inventive concept may be achieved by providing a variable capacity rotary compressor including first and second compression chambers having different capacities, a rotary shaft disposed through the first and second compression chambers, first and second eccentric cams mounted at the rotary shaft in the first and second compression chambers, respectively, first and second eccentric bushes rotatably mounted at outer surfaces of the first and second eccentric cams, respectively, a connection part connecting the first eccentric bushes, the connection part having a latching groove extending in a rotating direction, a latching pin protruding from the rotary shaft such that the latching pin is disposed in the latching groove, and holding grooves depressed by a predetermined depth at the opposite ends of the latching groove in a longitudinal direction of the rotary shaft to hold the latching pin therein.

The first and second eccentric bushes and the connection part may be movable in the longitudinal direction of the rotary shaft to engage the latching pin in one of the holding grooves.

The compressor may further include a spring to apply an elastic force the first and second eccentric bushes in the longitudinal direction of the rotary shaft.

The spring may have one end supported by a spring supporting protrusion formed at the rotary shaft and another end supported in a spring receiving groove formed at one of the first and second eccentric bushes.

Each of the holding grooves may be formed in the shape of a semicircle.

The foregoing and/or other aspects of the present general inventive concept may also be achieved by providing a variable capacity rotary compressor, including first and second compression chambers having different volumes, a rotary shaft disposed through the first and second compression chambers, a latching pin disposed at the rotary shaft to move to one of first and second positions by a rotation direction of the rotary shaft to activate one of the first and second compression chambers, respectively, and a holding unit including holding grooves to accommodate the latching pin to control the latching pin to remain at the one of the first and second positions until the rotation direction is reversed.

The foregoing and/or other aspects of the present general inventive concept may also be achieved by providing a variable capacity rotary compressor, including first and second compression chambers having different volumes, a rotary shaft disposed through the first and second compression chambers to rotate in a first direction and a second direction, and an eccentric unit disposed at the rotary shaft to rotate with the shaft at a first position when the rotary shaft rotates in the first direction and at a second position when the rotary shaft rotates in the second direction and to move along the rotary shaft in a longitudinal direction of the rotary shaft by a predetermined distance at the first and second positions to prevent slipping from the first and second positions.

The foregoing and/or other aspects of the present general inventive concept may also be achieved by providing a variable capacity rotary compressor according, including a first compression chamber and a second compression chamber having different volumes and respectively comprising first and second rollers to compress gas, an eccentric unit to move between first and second positions, to rotate the first roller at the first position and to rotate the second roller at the second position, and comprising a guiding groove having a circumferential portion formed in a circumferential direction of the eccentric unit and longitudinal portions formed at opposite ends of the circumferential portion in a longitudinal direction of the eccentric unit, and a rotary shaft disposed through the first and second compression chambers, connected to the eccentric unit, and comprising a latching pin protruding therefrom to move between the longitudinal portions of the guiding groove to move the eccentric unit between the first and second positions according to a direction of rotation of the rotating shaft.

BRIEF DESCRIPTION OF THE DRAWINGS

These and/or other aspects of the general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
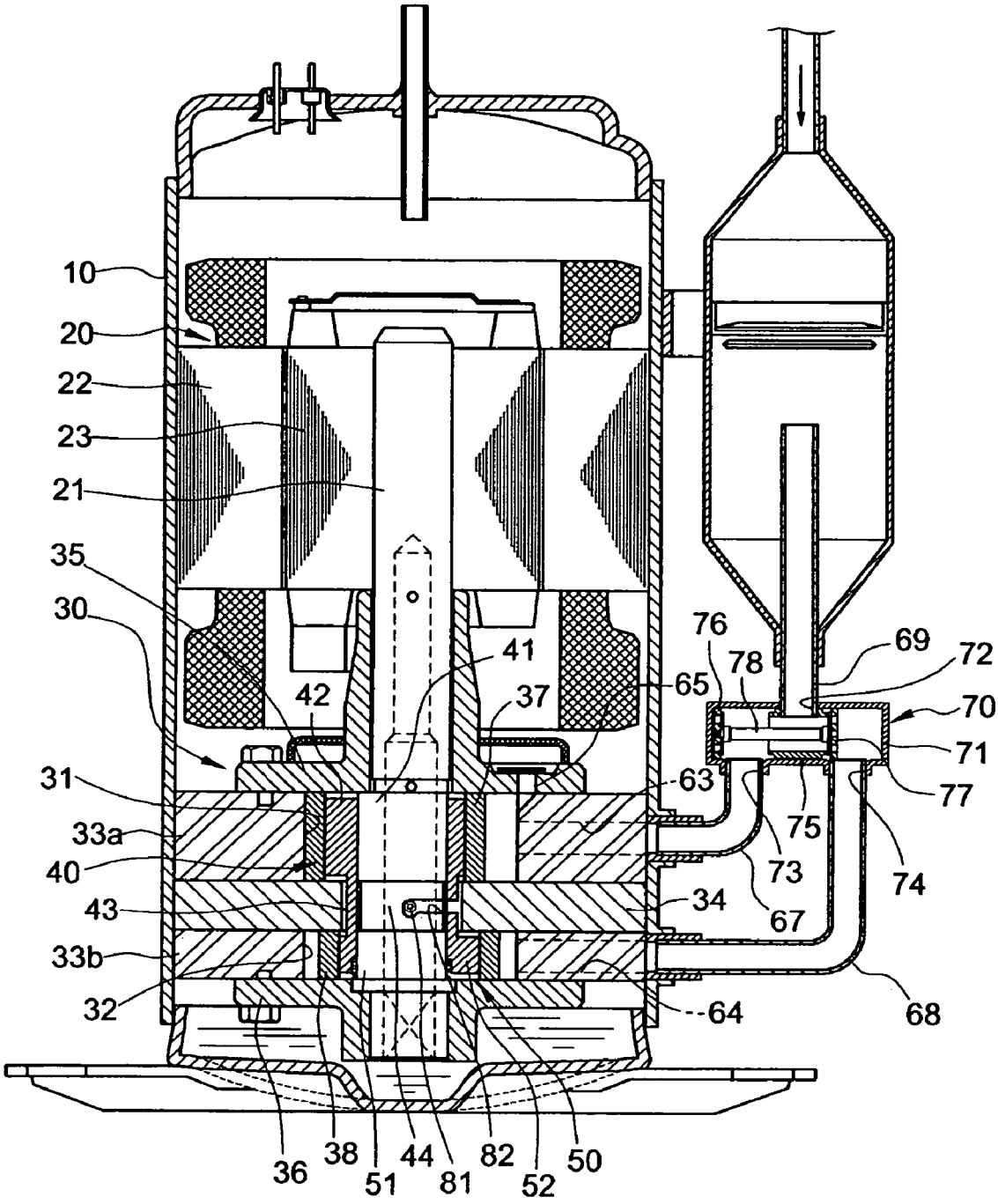
FIG. 1 is a longitudinal sectional view illustrating a structure of a variable capacity rotary compressor according to an embodiment of the present general inventive concept.

Reference will now be made in detail to the embodiment of the present general inventive concept, examples of which are illustrated in the accompanying drawings, wherein like reference numerals refer to like elements throughout. The embodiment is described below to explain the present general inventive concept while referring to the figures.

FIGS. 1-10 illustrate a structure of a variable capacity rotary compressor according to an embodiment of the present general inventive concept. Referring to FIGS. 1-10, the variable capacity rotary compressor includes a driving mechanism 20 mounted at an upper portion of a hermetically sealed container 10 to generate a rotary force, and a compressing mechanism 30 mounted at a lower portion of the container 10. The compressing mechanism 30 is connected to the driving mechanism 20 via a rotary shaft 21.

The driving mechanism 20 includes a cylindrical stator 22 fixed to an inner surface of the container 10, and a rotor 23 rotatably disposed in the stator 22 and having a center portion fitted on the rotary shaft 21. A rotating direction of the rotor 23 can be changed by controlling electric current supplied to the stator 22. Accordingly, the rotary shaft 21 can be rotated in alternating directions.

The compressing mechanism 30 includes an upper housing 33*a* having a cylindrical first compression chamber 31 defined therein, and a lower housing 33*b* having a cylindrical second compression chamber 32 defined therein. A volume of the second compression chamber 32 is less than that of the first compression chamber 31. The compressing mechanism 30 can further include an intermediate plate 34 disposed between the upper housing 33*a* and the lower housing 33*b* to separate the first compression chamber 31 and the second compression chamber 32 from each other, and first and second flanges 35 and 36 mounted at an upper surface of the upper housing 33*a* and a lower surface of the lower housing 33*b*, respectively, to close an upper portion of the first compression chamber 31 and a lower portion of the second compression chamber 32 while rotatably supporting the rotary shaft 21.

Figure 2:
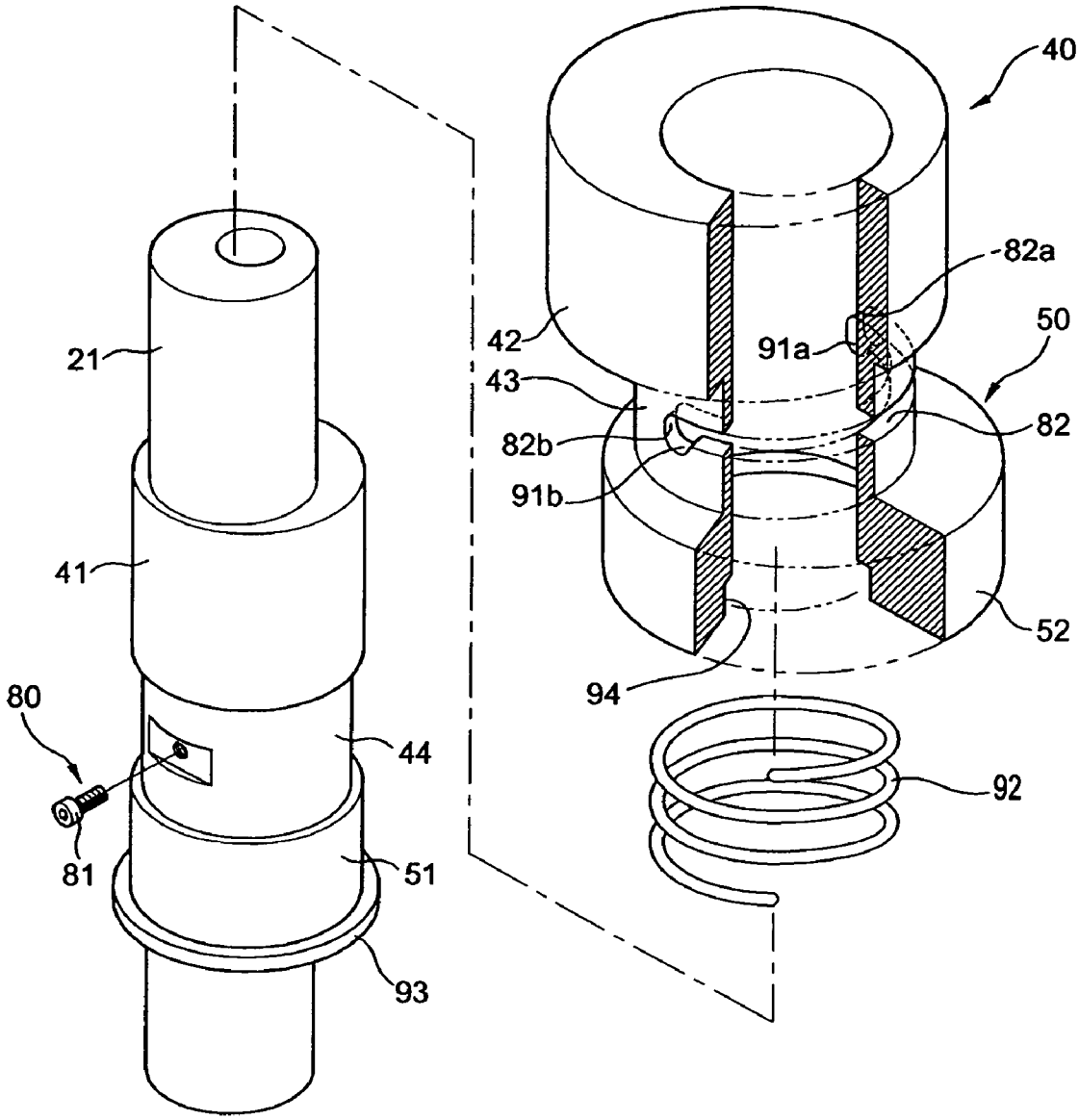
FIG. 2 is an exploded perspective view illustrating eccentric units of the variable capacity rotary compressor of FIG. 1.
Figure 3:
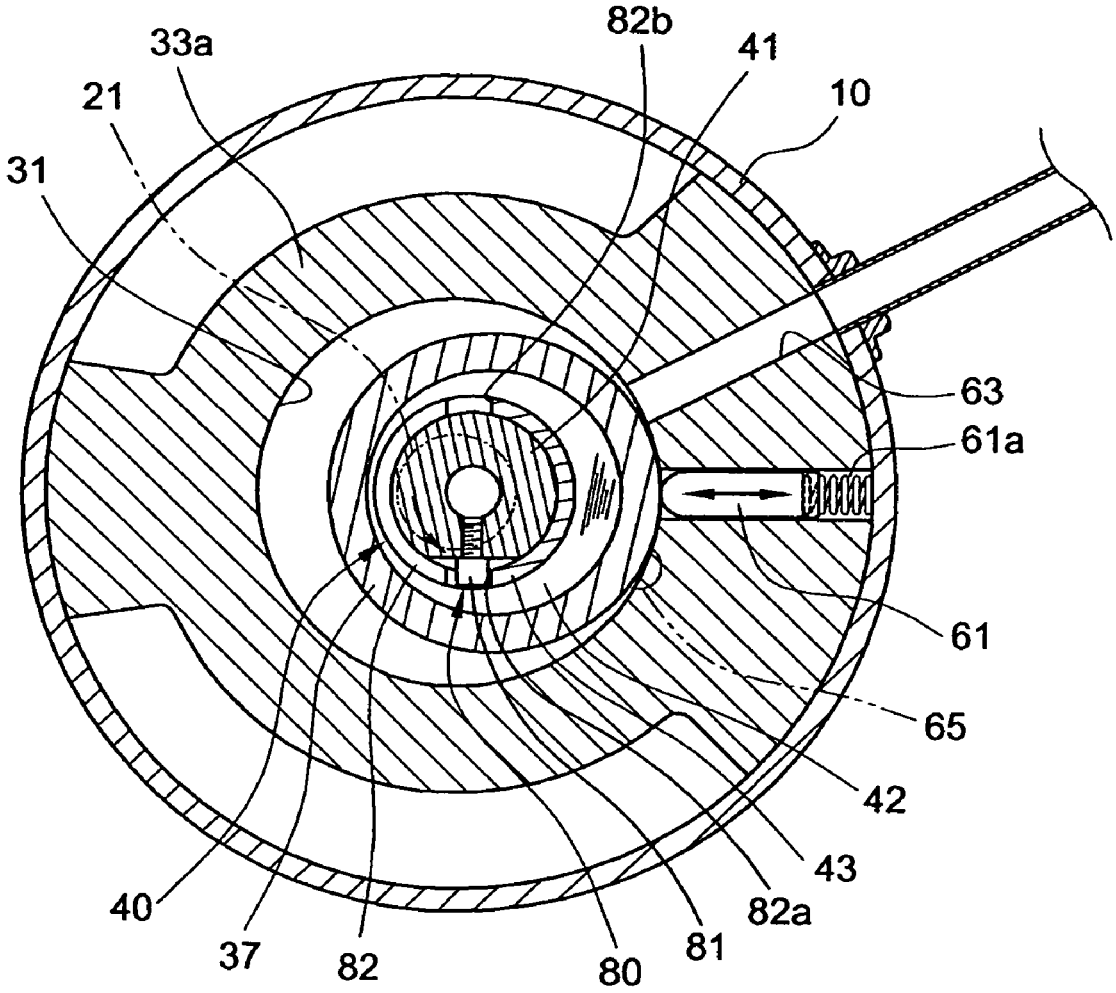
FIG. 3 is a sectional view illustrating a compressing operation in a first compression chamber when a rotary shaft of the variable capacity rotary compressor of FIG. 1 is rotated in a first direction.
Figure 4:
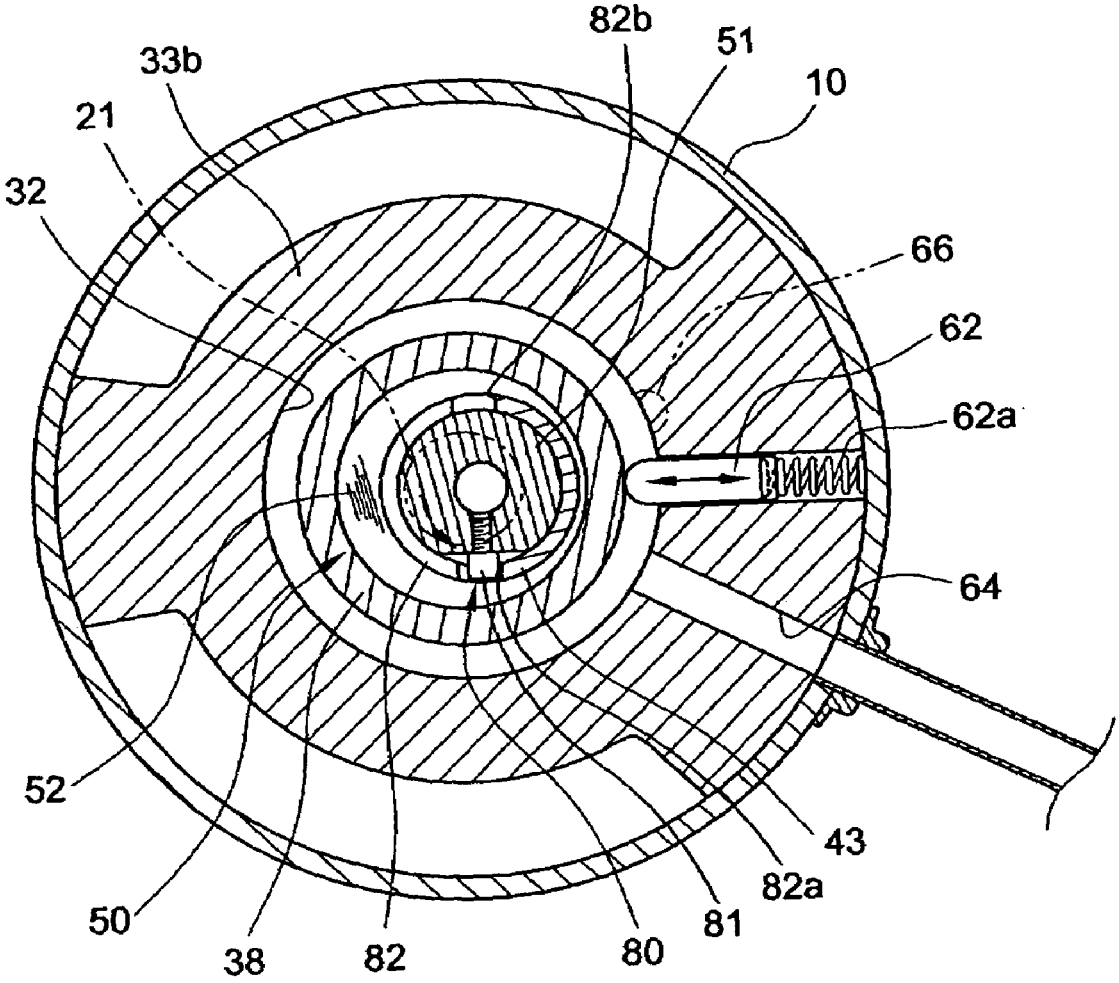
FIG. 4 is a sectional view illustrating an idling operation in a second compression chamber when the rotary shaft of the variable capacity rotary compressor of FIG. 1 is rotated in the first direction.

At the rotary shaft 21 in the first compression chamber 31 and the second compression chamber 32 are mounted a first eccentric unit 40 and a second eccentric unit 50, respectively, as shown in FIGS. 2 to 4. A first roller 37 and a second roller 38 are rotatably disposed at outer portions of the first and second eccentric units 40 and 50, respectively.

A first vane 61 is disposed between a first inlet port 63 and a first outlet port 65 of the first compression chamber 31, and a second vane 62 is disposed between a second inlet port 64 and a second outlet port 66 of the second compression chamber 32. The first and second vanes 61 and 62 move in a radial direction of the first and second compression chambers 31 and 32 while contacting outer surfaces of the first and second rollers 37 and 38, respectively, as illustrated in FIGS. 3 and 4. The first and second vanes 61 and 62 are supported by first and second vane springs 61*a* and 61*b*, respectively. The first and second inlet ports 63 and 64 of the first and second compression chambers 31 and 32 are disposed opposite to the first and second outlet ports 65 and 66 of the first and second compression chambers 31 and 32 with respect to the first and second vanes 61 and 62.

The first and second eccentric units 40 and 50 respectively include first and second eccentric cams 41 and 51 formed at an outer surface of the rotary shaft 21 in the first and second compression chambers 31 and 32 such that the first and second eccentric cams 41 and 51 are eccentric in the same direction. The first and second eccentric units 40 and 50 also respectively include first upper and second eccentric bushes 42 and 52 rotatably mounted at outer surfaces of the first and second eccentric cams 41 and 51, respectively. As illustrated in FIG. 2, the first eccentric bush 42 is integrally connected to the second eccentric bush 52 via a cylindrical connection part 43. The eccentric direction of the first eccentric bush 42 is opposite to that of the second eccentric bush 52. That is the first and second eccentric bushes 42 and 52 are asymmetrically disposed with respect to the rotary shaft 21 and disposed opposite to each other with respect to the connection part 43. The first and second rollers 37 and 38 are rotatably mounted at outer surfaces of the first and second eccentric bushes 42 and 52, respectively.

As illustrated in FIG. 2, an eccentric part 44 is provided at the outer surface of the rotary shaft 21 between the first and second eccentric cams 41 and 51. The eccentric part 44 is eccentric in the same direction as at least one of the first and second eccentric cams 41 and 51. At the eccentric part 44 and the connection part 43 is provided a latching unit 80 to allow the first and second eccentric bushes 42 and 52 to be rotated while being eccentric to the rotary shaft 21 or not being eccentric to the rotary shaft 21 as the rotating direction of the rotary shaft 21 is changed.

The latching unit 80 includes a latching pin 81 threadedly attached to a predetermined position of an outer surface of the eccentric part 44, and a latching groove 82 formed at the connection part 43 extending in the rotating direction such that the latching pin 81 can be latched at an eccentric position and an eccentric releasing position of the first and second eccentric bushes 42 and 52 according to the rotation of the rotary shaft 21.

When the rotary shaft 21 is rotated while the latching pin 81 attached to the eccentric part 44 of the rotary shaft 21 is placed in the latching groove 82, the latching pin 81 is latched in a first latching portion 82*a* or a second latching portion 82*b*, which are formed at opposite ends of the latching groove 82. Accordingly, the first and second eccentric bushes 42 and 52 are rotated along with the rotary shaft 21. When the latching pin 81 is latched in the first latching portion 82*a* or the second latching portion 82*b* of the latching groove 82, one of the first and second eccentric bushes 42 and 52 is at a maximum eccentric position with respect to the rotary shaft 21, and the other one of the first and second eccentric bushes 42 and 52 is at a coaxial position with respect to the rotary shaft 21, and therefore, a compressing operation is performed in the one of the first and second compression chambers 31 and 32 at the maximum eccentric position, and an idling operation is performed in the other one of the first and second eccentric bushes 42 and 52 at the coaxial position. When the rotating direction of the rotary shaft 21 is changed, the eccentric states of the first and second eccentric bushes 42 and 52 are reversed.

Figure 7:
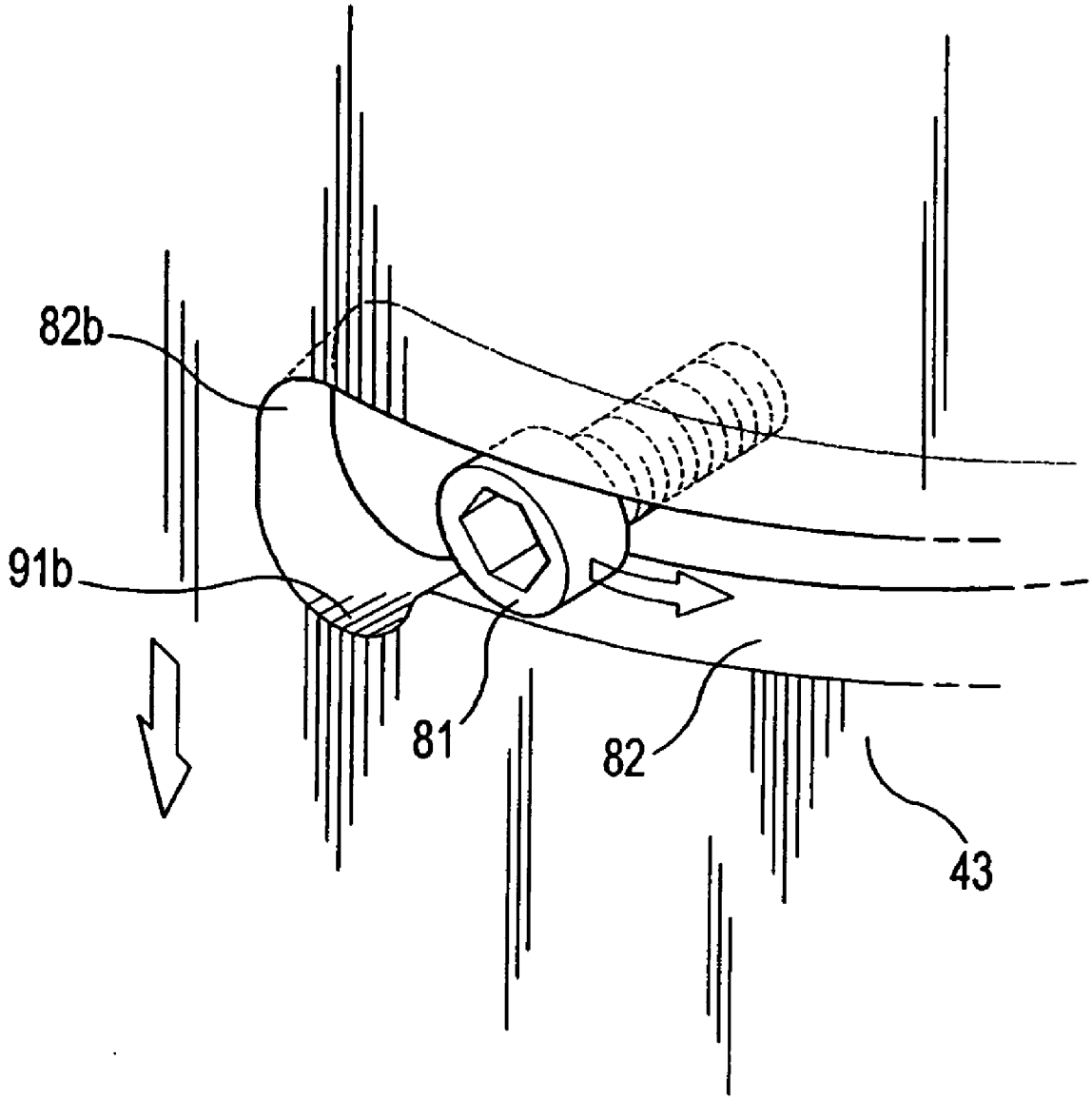
FIG. 7 is a perspective view illustrating a latching pin and a latching groove of the variable capacity rotary compressor of FIG. 1 when the latching pin is disengaged from a holding groove.

As illustrated in FIGS. 2 and 7, the variable capacity rotary compressor further includes first and second holding grooves 91*a* and 91*b* depressed by a predetermined depth in the shape of a semicircle at the opposite ends of the latching groove 82 to hold the latching pin 81 when the latching pin 81 is placed in one of the opposite ends of the latching groove as the rotary shaft 21 is rotated. The latching groove 82 is formed to connect the first and second holding grooves 91*a* and 91*b*. The first and second eccentric bushes 42 and 52 and the connection part 43 are movable by a predetermined length in a longitudinal direction of the rotary shaft 21. A spring 92 is disposed between the second eccentric cam 51 and the second eccentric bush 52 to apply an elastic force to the first and second eccentric bushes 42 and 52 and the connection part 43 in the longitudinal direction of the rotary shaft 21. The spring 92 has one end supported by a spring supporting protrusion 93 formed at the rotary shaft 21 and another end supported in a spring receiving groove 94 formed at an inner circumference of the second eccentric bush 52.

When the latching pin 81 is placed at one of the opposite ends of the latching groove 82, the first and second eccentric bushes 42 and 52 and the connection part 43 are moved in an axial direction (upward), and therefore, the latching pin 81 is engaged in one of the first and second holding grooves 91*a* and 91*b*. Accordingly, slippage of the first and second eccentric bushes 42 and 52 is prevented while the compressing operation is performed. The predetermined depth of the first and second holding grooves 91*a* and 91*b* can be less than the diameter of the latching pin 81 such that the latching pin 81 can be easily disengaged from the corresponding holding groove 91*a* or 91*b* when the rotary shaft 21 is rotated in alternating directions. The predetermined depth of the first and second holding grooves 91*a* and 91*b* can be equal to a radius of the semicircular shape of the first and second holding grooves 91*a* and 91*b*. A width of the first and second holding grooves 91*a* and 91*b* and the first and second latching portions 82*a* and 82*b* of the latching groove 82 in the longitudinal direction of the rotary shaft 21 can be greater than the diameter of the latching pin 81.

If the depth of the first and second holding grooves 91*a* and 91*b* is increased, and an elastic force of the spring 92 is increased, a holding force of the latching pin 81 can also be increased. However, in this case, the latching pin 81 may not disengage from the corresponding holding groove 91*a* or 91*b* when the rotary shaft 21 is rotated in alternating directions. As a result, a capacity-changing operation may not be properly performed. Accordingly, the first and second holding grooves 91*a* and 91*b* can have an appropriate depth, and the spring 92 can have an appropriate elastic force such that the latching pin 81 can disengage from the first and second holding grooves 91*a* and 91*b* when the direction of rotation of the rotary shaft 21 is changed. The holding force of the latching pin 81, which can be determined by the depth of the first and second holding grooves 91*a* and 91*b* and the elastic force of the spring 92, is sufficient to prevent slippage of the eccentric bushes 42 and 52 while the compressing operation is being performed.

As illustrated in FIG. 1, the variable capacity rotary compressor can further a channel changing unit 70 to change inlet channels such that refrigerant can be introduced from an inlet pipe 69 through the inlet port 63 or 64 of the compression chamber 31 or 32 where the compressing operation is performed, i.e., through the first inlet port 63 of the first compression chamber 31 or the second inlet port 64 of the second compression chamber 32.

The channel changing unit 70 includes a cylindrical body 71 and a valve device mounted in the body 71. The inlet pipe 69 is connected to an inlet 72 formed at a center portion of the body 71. First and second pipes 67 and 68 connect first and second outlets 73 and 74 formed at opposite sides of the body 71, to the first inlet port 63 of the first compression chamber 31 and the second inlet port 64 of the second compression chamber 32, respectively. The valve device includes a cylindrical valve seat 75 mounted at the center portion of the body 71, first and second opening/closing members 76 and 77 movably disposed at the opposite sides of the body 71 within the body 71 to open and close opposite ends of the valve seat 75, and a connection member 78 connected between the opening/closing members 76 and 77 such that the opening/closing members 76 and 77 are moved simultaneously. When the compressing operation is performed in one of the first and second compression chambers 31 and 32, the first and second opening/closing members 76 and 77 are moved to a low-pressure side of the body 71 by a difference in pressure applied to the first and second outlets 73 and 74, and therefore, the inlet channels are automatically changed.

Operations of the variable capacity rotary compressor as illustrated in FIGS. 1-10 will be described below.

When the rotary shaft 21 is rotated in a first direction, as illustrated in FIG. 3, the latching pin 81 engages in the first latching portion 82*a* of the latching groove 82, and the outer surface of the first eccentric bush 42 in the first compression chamber 31 is at the maximum eccentric position with respect to the rotary shaft 21. Accordingly, the first roller 37 rotates while contacting the inner surface of the first compression chamber 31, and therefore, the compressing operation is performed in the first compression chamber 31. When the rotary shaft 21 rotates in the first direction, the outer surface of the second eccentric bush 52, which is eccentric in the direction opposite to the first eccentric bush 42, is at the coaxial position with respect to the rotary shaft 21, as illustrated in FIG. 4. Accordingly, the second roller 38 is spaced apart from the inner surface of the second compression chamber 32, and therefore, the idling operation is performed in the second compression chamber 32. When the compressing operation is performed in the first compression chamber 31, the refrigerant is introduced through the first inlet port 63 of the first compression chamber 31. Accordingly, the inlet channel is controller by the channel changing unit 70 such that the refrigerant is introduced only into the first compression chamber 31.

As described above, the first and second eccentric cams 41 and 51 are eccentric in the same direction, and the first and second eccentric bushes 42 and 52 are eccentric in opposite directions. When the direction of a maximum eccentric portion of the first eccentric cam 41 is the same as that of a maximum eccentric portion of the first eccentric bush 42, the direction of a maximum eccentric portion of the second eccentric cam 51 is opposite to that of a maximum eccentric portion of the second eccentric bush 52.

Figure 5:
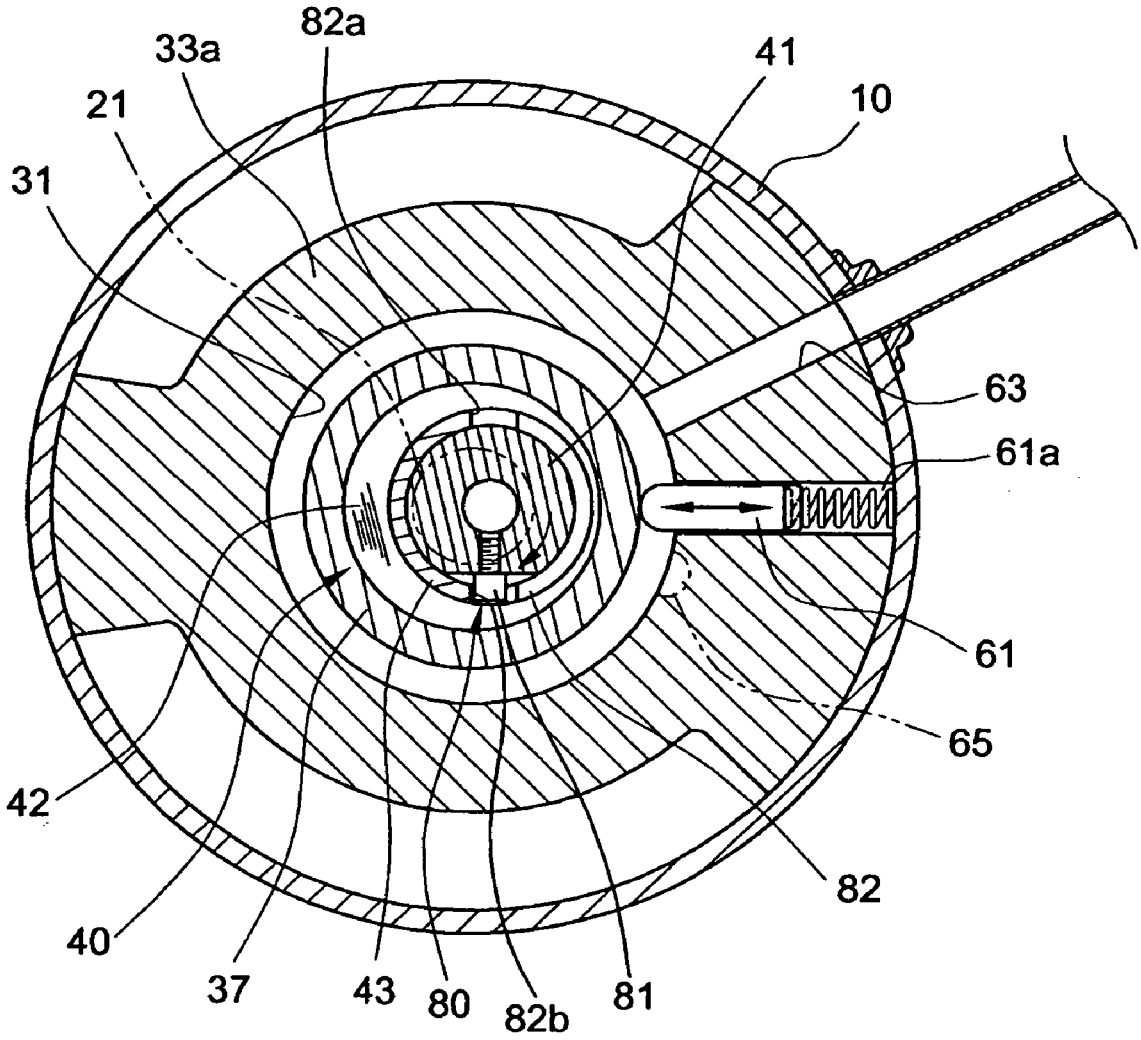
FIG. 5 is a sectional view illustrating an idling operation in the first compression chamber when the rotary shaft of the variable capacity rotary compressor of FIG. 1 is rotated in a second direction.
Figure 6:
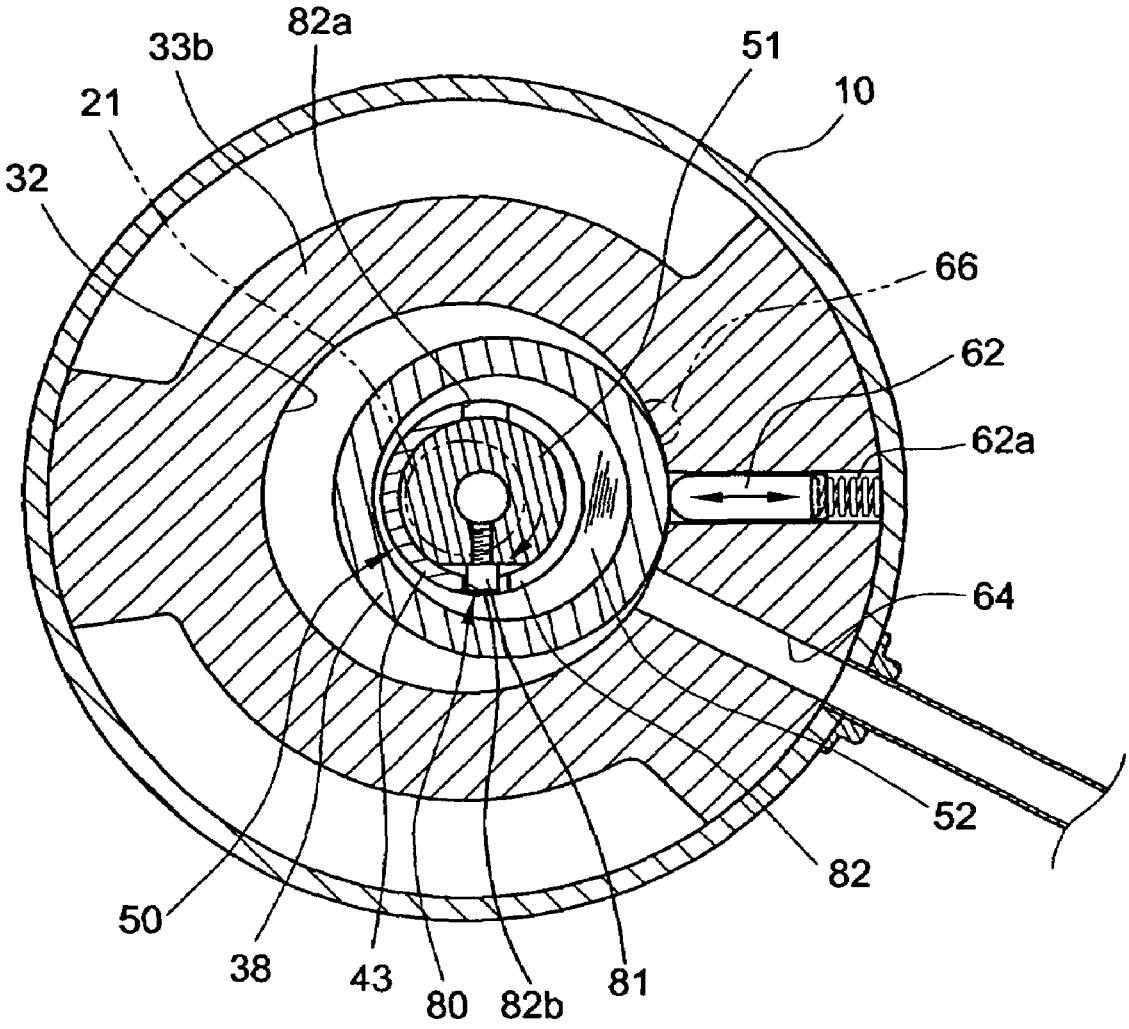
FIG. 6 is a sectional view illustrating a compressing operation in the second compression chamber when the rotary shaft of the variable capacity rotary compressor of FIG. 1 is rotated in the second direction.

When the rotary shaft 21 is rotated in a second direction opposite to the first direction, as illustrated in FIG. 5, the latching pin 81 engages in the second latching portion 82*b* of the latching groove 82 while the outer surface of the first eccentric bush 42 in the first compression chamber 31 is at the coaxial position with respect to the rotary shaft 21. Accordingly, the first roller 37 is spaced apart from the inner surface of the first compression chamber 31, and therefore, the idling operation is performed in the first compression chamber 31. When the rotary shaft 21 is rotated in the second direction, the outer surface of the second eccentric bush 52 is at the maximum eccentric position with respect to the rotary shaft 21, and the second roller 38 is rotated while contacting the inner surface of the second compression chamber 32, as illustrated in FIG. 6. Accordingly, the compressing operation is performed in the second compression chamber 32.

When the compressing operation is performed in the second compression chamber 32, the refrigerant is introduced through the second inlet port 64 of the second compression chamber 32. Accordingly, the inlet channel is controller by the channel changing unit 70 such that the refrigerant is introduced only into the second compression chamber 32.

Figure 8:
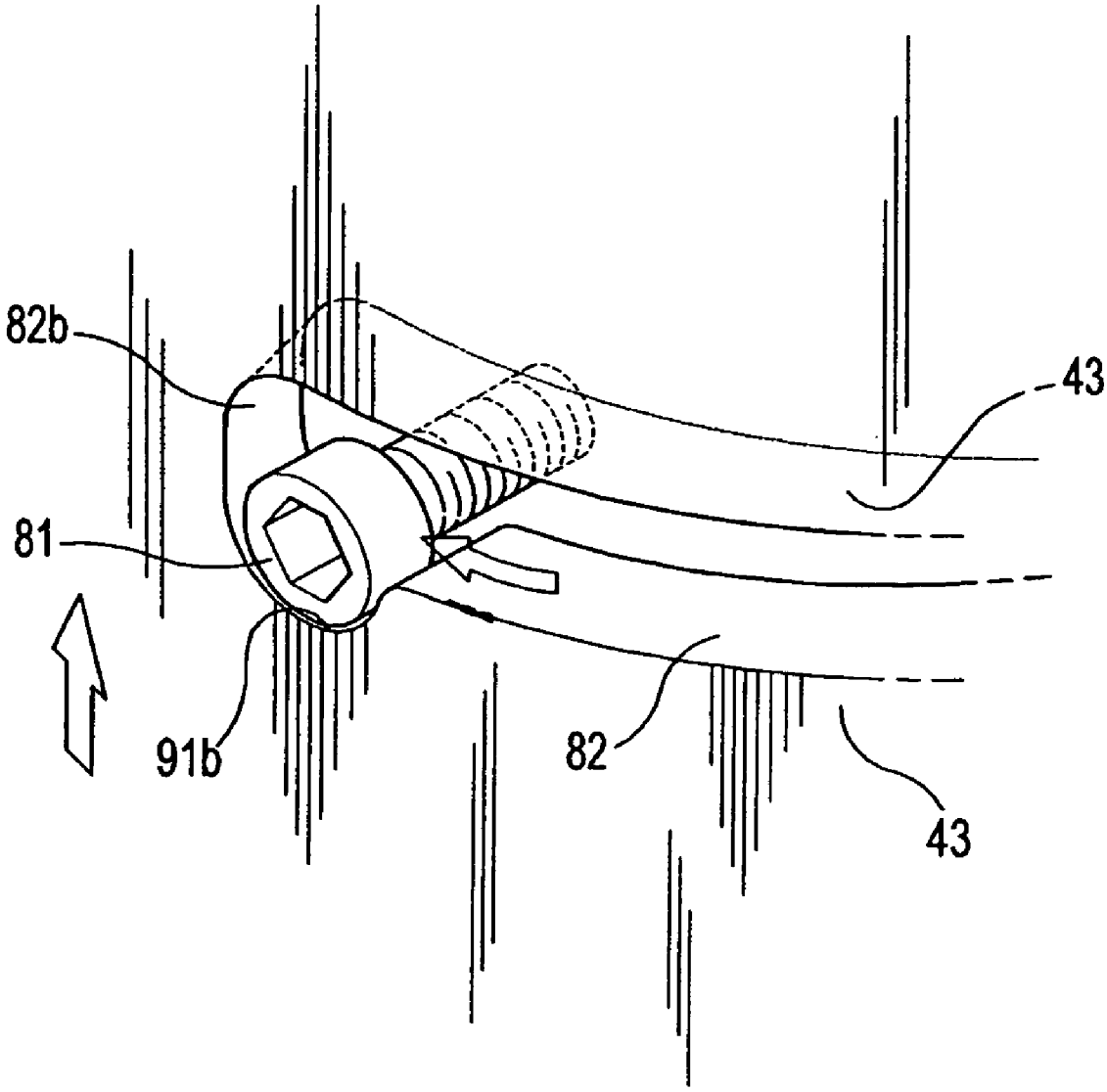
FIG. 8 is a perspective view illustrating the latching pin and the latching groove of the variable capacity rotary compressor of FIG. 1 when the latching pin is engaged in the holding groove.
Figure 10:
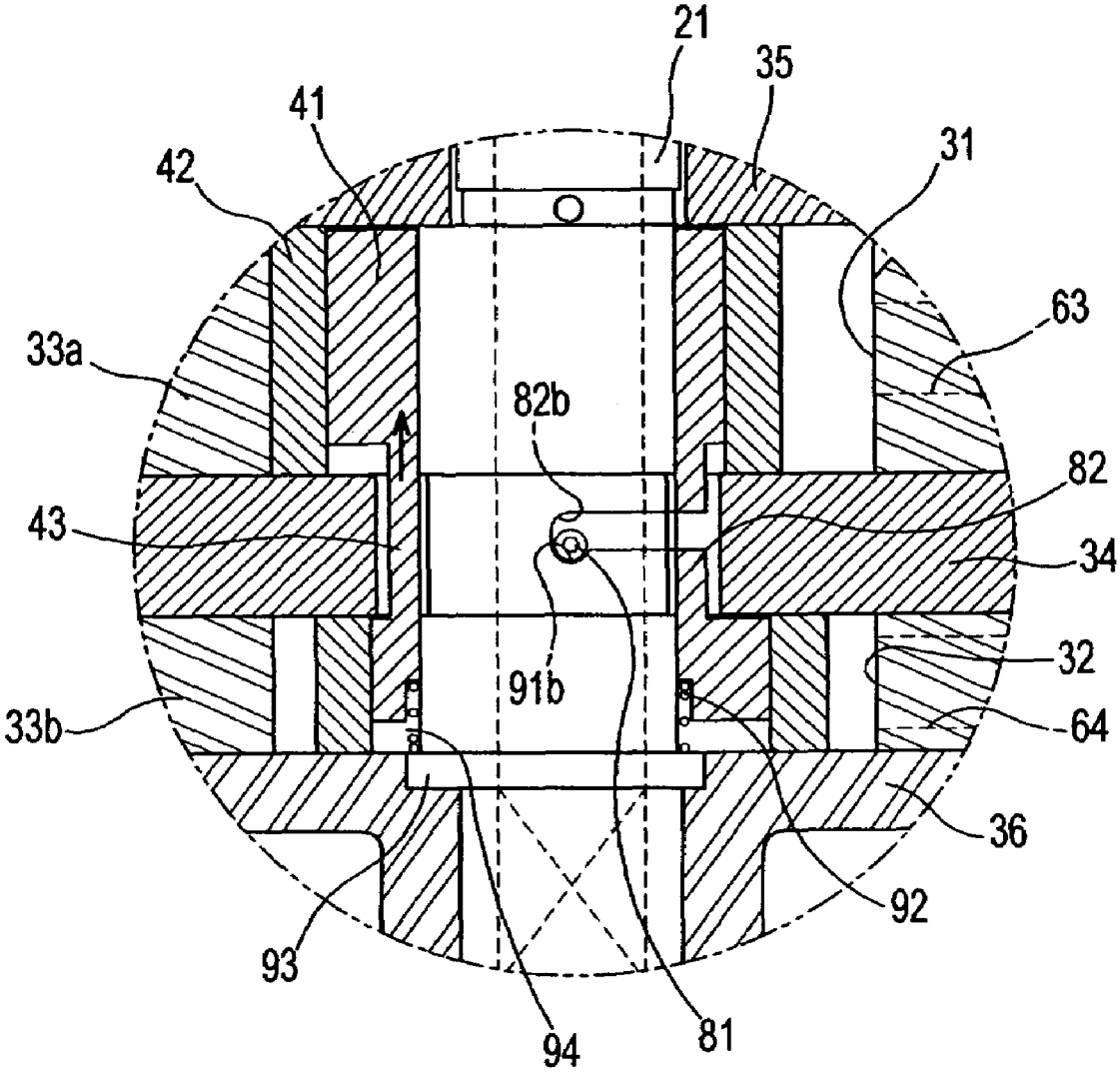
FIG. 10 is a detailed sectional view illustrating the eccentric units of the variable capacity rotary compressor of FIG. 1 when the latching pin is engaged in the holding groove.

FIGS. 8 and 10 illustrate the variable capacity rotary compressor when the compressing operation is performed in the second compression chamber 32 as described above. As illustrated in FIGS. 8 and 10, the latching pin 81 is engaged in the second holding groove 91*b* disposed at one of the opposite ends of the latching groove 82 when the rotary shaft 21 is rotated in the second direction. When the latching pin 81 is moved to the second latching portion 82*b* of the latching groove 82 as the rotary shaft 21 rotates, the first and second eccentric bushes 42 and 52 and the connection part 43 are moved upward by the elastic force of the spring 92. As a result, the latching pin 81 engages in the holding groove 91*b*, thereby preventing slippage of the eccentric bushes 42 and 52, which may be caused when the eccentric bushes 42 and 52 are rotated at a speed greater than the first and second eccentric cams 41 and 51.

Figure 9:
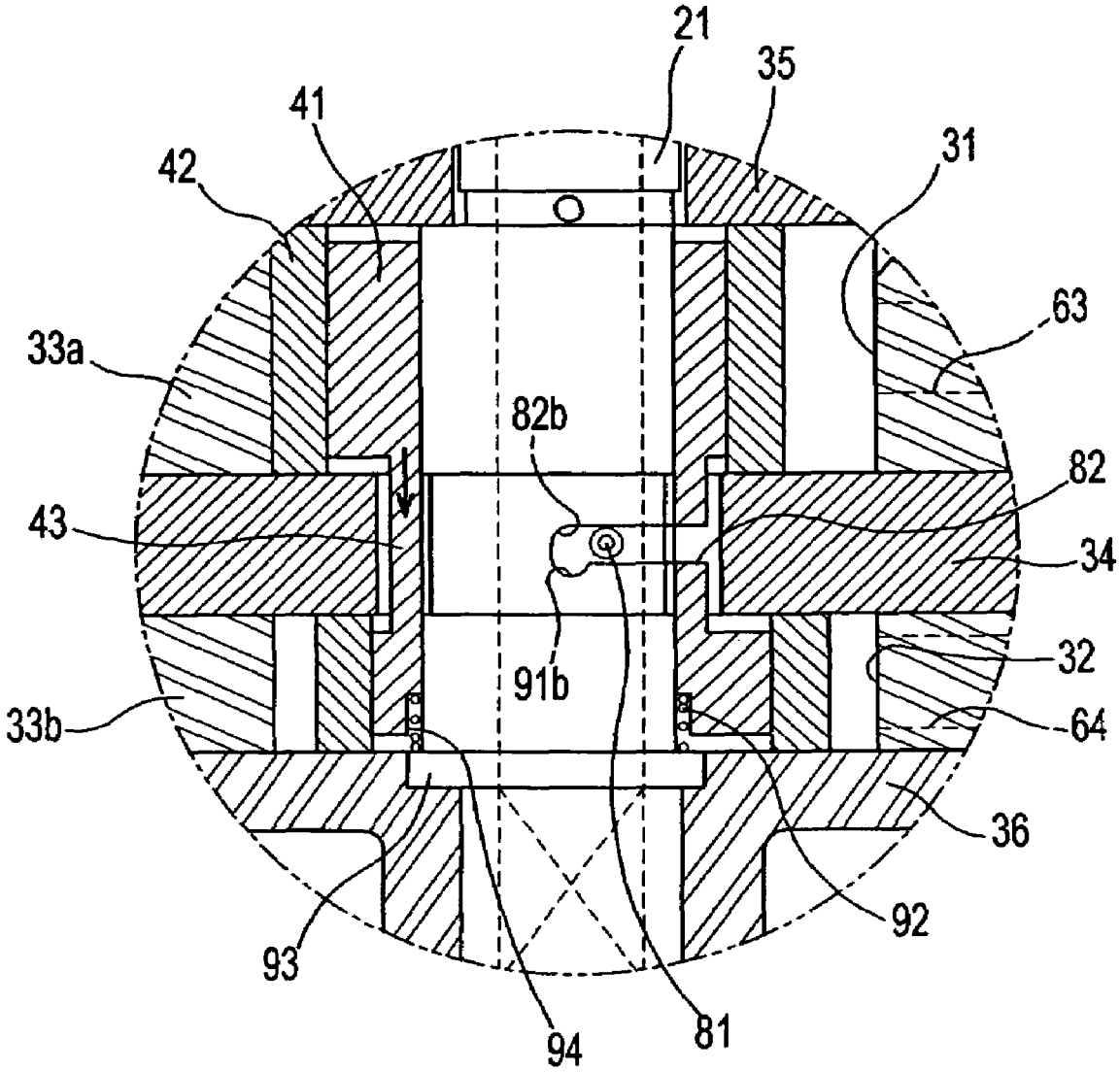
FIG. 9 is a detailed sectional view illustrating the eccentric units of the variable capacity rotary compressor of FIG. 1 when the latching pin is disengaged from the holding groove.

FIGS. 7 and 9 illustrate the variable capacity rotary compressor when the direction of rotation of the rotary shaft is switched from the second direction to the first direction to change the compression capacity. As illustrated in FIGS. 7 and 9 a rotating resistance is applied to the first and second eccentric bushes 42 and 52, and therefore, the latching pin 81 is disengaged from the second holding groove 91 b, and is then moved toward the first latching portion 82*a* of the latching groove 82. The latching pin 81 can easily be disengaged from the second holding groove 91*b* because the second holding groove 91*b* is formed in the shape of a semicircle. When the latching pin 81 is disengaged from the second holding groove 91*b*, the first and second eccentric bushes 42 and 52 and the connection part 43 are moved downward the predetermined length, and therefore, the spring 92 is slightly compressed. When the latching pin 81 reaches the first latching part 82*a* of the latching groove 82, the first and second eccentric bushes 42 and 52 and the connection part 43 are moved upward by the elastic force of the spring 92. Accordingly, the latching pin 81 then engages in the first holding groove 91*a*.

As described above, a latching pin is engaged in one of holding grooves formed at the opposite ends of a latching groove when a compressing operation is performed. Accordingly, a structure of a variable capacity rotary compressor can be simplified, the slippage of eccentric bushes can be prevented, and a capacity-changing operation can be smoothly performed.

Furthermore, a latching pin holding structure can be simpler than the in conventional art, and therefore, manufacturing costs and time are reduced.

Although an embodiment of the present general inventive concept has been shown and described, it would be appreciated by those skilled in the art that changes may be made in this embodiment without departing from the principles and spirit of the general inventive concept, the scope of which is defined in the claims and their equivalents.

What is claimed is:

1. A variable capacity rotary compressor, comprising:

first and second compression chambers having different capacities;

a rotary shaft disposed through the first and second compression chambers;

first and second eccentric cams mounted at the rotary shaft in the first and second compression chambers, respectively;

first and second eccentric bushes rotatably mounted at outer surfaces of the first and second eccentric cams, respectively;

a connection part to connect the first and second eccentric bushes, the connection part having a latching groove extending in a rotating direction of the rotary shaft;

a latching pin protruding from the rotary shaft such that the latching pin is disposed in the latching groove; and holding grooves depressed by a predetermined depth at opposite ends of the latching groove in a longitudinal direction of the rotary shaft to hold the latching pin therein, wherein the first and second eccentric bushes and the connection part are movable in a longitudinal direction with respect to rotary shaft to engage the latching pin in one of the holding grooves.

2. The compressor according to claim 1, further comprising:

a spring to apply an elastic force to bias the first and second eccentric bushes in the longitudinal direction.

3. The compressor according to claim 2, further comprising:

a spring supporting protrusion formed at the rotary shaft to support one end of the spring; and a spring receiving groove formed at one of the first and second eccentric bushes to support another end of the spring.

4. The compressor according to claim 2, wherein each of the holding grooves is formed in a shape of a semicircle.

5. The compressor according to claim 1, wherein the predetermined depth of the holding grooves is less than a diameter of the latching pin.

6. A variable capacity rotary compressor, comprising:

first and second compression chambers having different volumes;

a rotary shaft disposed through the first and second compression chambers;

a latching pin disposed at the rotary shaft to move to one of first and second positions by a rotation direction of the rotary shaft to activate one of the first and second compression chambers; and a holding unit including holding grooves to accommodate the latching pin to control the latching pin to remain at the one of the first and second positions until the rotation direction is reversed, wherein the latching pin is accommodate into the holding grooves by a longitudinal movement of an eccentric unit movably coupled to the rotary shaft.

7. The variable capacity rotary compressor according to claim 6, wherein the eccentric unit comprises:

a first eccentric unit disposed at the rotation shaft in the first compression chamber to activate the first compression chamber when the latching pin is at the first position;

a second eccentric unit disposed at the rotation shaft in the second compression chamber to activate the second compression chamber when the latching pin is at the second position;

a connection portion to connect the first and second eccentric unit; and a latching groove formed in the connection portion in a circumferential direction to accommodate the latching pin and to guide the movement of the latching pin between the first and second positions.

8. The variable capacity rotary compressor according to claim 7, wherein the holding unit comprises:

a first holding groove formed at a first end of the latching groove in a longitudinal direction to hold the latching pin at the first position when the rotary shaft is rotated in a first direction; and a second holding grove formed at the second end of the latching groove in the longitudinal direction to hold the latching pin at the second position when the rotary shaft is rotated in a second direction.

9. The variable capacity rotary compressor according to claim 8, wherein the holding unit further comprises:

a spring to elastically bias the first and second eccentric units in the longitudinal direction of the rotary shaft to engage the latching pin in the first and second holding grooves when the latching pin moves to the first and second positions.

10. The variable capacity rotary compressor according to claim 8, wherein the first and second holding grooves respectively extend from the first and second ends of the latching groove in the longitudinal direction by a distance less than a diameter of the latching pin.

11. A variable capacity rotary compressor, comprising:

first and second compression chambers having different volumes;

a rotary shaft disposed through the first and second compression chambers to rotate in a first direction and a second direction; and an eccentric unit disposed at the rotary shaft to rotate with the shaft at a first position when the rotary shaft rotates in the first direction and at a second position when the rotary shaft rotates in the second direction and to move along the rotary shaft in a longitudinal direction of the rotary shaft by a predetermined distance at the first and second positions to prevent slipping from the first and second positions.

12. The variable capacity rotary compressor according to claim 11, further comprising:

a guiding grove formed in the eccentric unit in a rotating direction of the rotary shaft;

a latching pin extending from the rotary shaft to be accommodated in the guiding groove and to contact opposite ends of the guiding groove to rotate the eccentric unit to the first and second positions; and first and second holding grooves formed in the eccentric unit at the opposite ends of the guiding groove and extending from the opposite ends of the guiding groove by the predetermined distance in the longitudinal direction of the rotary shaft to accommodate the latching pin and control a range of movement of the eccentric unit in the longitudinal direction of the rotary shaft.

13. The variable capacity rotary compressor according to claim 12, further comprising:

an elastic member to apply an elastic force to the eccentric unit to move the eccentric unit in the longitudinal direction at the first and second positions.

14. The variable capacity rotary compressor according to claim 13, wherein the elastic member controls the latching pin to engage with the first and second holding grooves when the latching pin rotates the eccentric unit to the first and second positions, respectively.

15. The variable capacity rotary compressor according to claim 12, wherein the predetermined distance is less than a diameter of the latching pin.

* * * * *